United States Patent [19]

McCarter

[11] Patent Number: 4,666,072

[45] Date of Patent: May 19, 1987

[54] DISPENSING CONTAINER FOR PLASTIC FILM WRAP

[76] Inventor: James T. McCarter, 228 McSwain Dr., Greenville, S.C. 29615

[21] Appl. No.: 842,734

[22] Filed: Mar. 21, 1986

Related U.S. Application Data

[63] Continuation of Ser. No. 614,431, May 25, 1984, abandoned.

[51] Int. Cl.[4] ..... B65D 85/671

[52] U.S. Cl. ..... 225/25; 225/48; 225/90

[58] Field of Search ..... 225/25, 26, 43, 48, 225/53, 90

[56] References Cited

U.S. PATENT DOCUMENTS

| | | | |
|---|---|---|---|
| 3,549,066 | 12/1970 | Wankow | 225/25 |
| 3,845,894 | 11/1974 | Merlin | 225/25 |
| 3,974,947 | 8/1976 | Budny | 225/25 |
| 4,307,828 | 12/1981 | Sias et al. | 225/25 |

FOREIGN PATENT DOCUMENTS

| | | | |
|---|---|---|---|
| 1385192 | 2/1975 | United Kingdom | 225/25 |

*Primary Examiner*—Frank T. Yost
*Assistant Examiner*—Hien H. Phan
*Attorney, Agent, or Firm*—Julian W. Dority

[57] ABSTRACT

A dispensing container (10, 52) is illustrated for dispensing clinging type plastic film wrap material which includes a front dispensing face (16, 50) having a dispensing opening (36, 60) from which plastic film wrap material (W) is dispensed. A cutting edge (32, 60) is carried adjacent a lower portion of the front face. An elongated adherence strip (40) is carried between the dispensing opening and cutting edge across the front face of the container. As the plastic film wrap material (W) is torn across the cutting edge for dispensing, the material is held by adherence and the remaining free end of the film wrap material (W) is left adhering to the adherence strip so that the film wrap material (W) is readily available to be grasped for dispensing of a next piece of material.

3 Claims, 5 Drawing Figures

DISPENSING CONTAINER FOR PLASTIC FILM WRAP

This is a continuation of application Ser. No. 614,431, filed May 25, 1984, which was abandoned upon the filing hereof.

BACKGROUND OF THE INVENTION

The invention relates to a box or other container from which clinging type plastic film material is dispensed such as utilized for wrapping food and other uses in the kitchen.

The typical plastic wrap film box includes a bottom section in which a roll of plastic film is received and a top which hinges and closes upon the bottom section. The plastic film wrap is pulled out over the top edge of the bottom section and a cutting edge is provided along the lower edge of the bottom section for tearing off a sheet of the plastic film. The problem occurs that when the plastic film is separated by tearing the film across the cutting edge, the free edge of the plastic film material is often difficult to locate when again wanting to pull out a length of the plastic film material. When the box is new, the plastic film material is normally adhered to the roll making it difficult to find the free end of the plastic film material.

Accordingly, an important object of the present invention is to provide a box-type container for dispensing plastic film material of the clinging type wherein the free edge of the plastic film wrap is always located on the dispensing side of the box at a position at which it is easily grasped by the user for pulling out the film wrap and separating the film wrap from the roll.

Still another important object of the present invention is to provide a dispensing container for plastic film wrap material of the type which clings and in which the free edge of the plastic wrap material is automatically fixed to the side of the box by means of an adherence strip between the dispensing opening and the cutting edge of the box.

Still another important object of the present invention is to provide a container for plastic film wrap having an adherence strip on the dispensing side of the box to which a free edge of the film wrap material may be adhered so that starting of the dispensing of the film wrap is facilitated from a new box.

SUMMARY OF THE INVENTION

The above objectives are accomplished according to the present invention by providing a dispensing container for plastic film wrap material of the clinging type wherein the container includes a bottom section in which a roll of film wrap material is received and a top section which hinges to cover the bottom section. A dispensing side of the container includes a dispensing opening through which the plastic film wrap material is dispensed and a cutting edge across which the plastic film wrap material may be torn. Intermediate the dispensing opening and the cutting edge is an elongated strip of adherence material to which the plastic film wrap automatically adheres when the film wrap material is torn across the cutting edge. As a piece of the film wrap material is separated by tearing across the cutting edge, the free edge is automatically adhered to the front face of the box so that it is in a convenient location to be readily grasped for dispensing of a next piece of film wrap material.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The present invention relates to a container for dispensing plastic film wrap material of the type which will cling to itself and other type substrate materials. This type of plastic film wrap material is used extensively in the kitchen for wrapping food and providing a covering for other containers. The material has a tendency when dispensed from a roll to retract back into the roll after it is dispensed and making the free edge of the material difficult to find for pulling off another sheet of material.

The typical plastic film wrap box includes a cardboard box having a bottom section and a hinged section which covers the bottom section. When purchased, the top section and bottom section are normally fastened together by means of a cardboard tab which covers over a cutting edge carried by a lower edge of the bottom section. To open the box, the cardboard tab is pulled across the dispensing face of the box leaving the top section truncated and the lower cutting edge exposed for cutting and dispensing of the plastic film wrap material.

In the cardboard type box, the film material often continues to be pulled off of the roll as it is torn across the cutting edge making cutting and control of the piece size difficult.

The present invention may be utilized with the conventional cardboard type plastic film wrap box or may also be utilized with a decorative box made from plastic. In either event, the advantages of the present invention will be readily recognized having been taught the invention herein.

Figure 1:
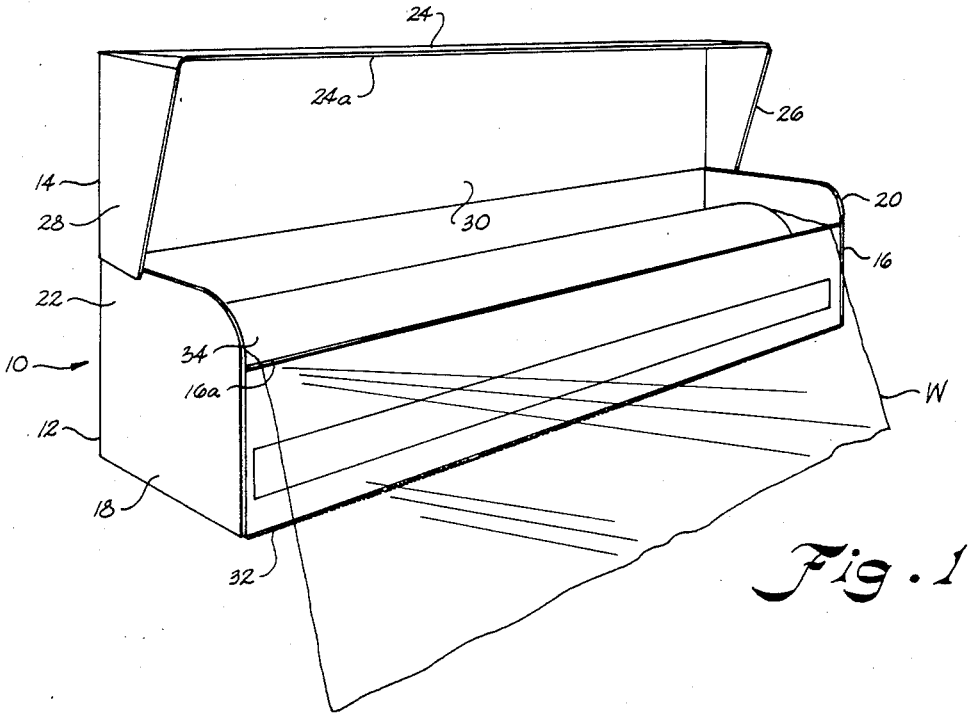
FIG. 1 is a perspective view illustrating a plastic film wrap/box constructed according to the present invention/with the top open.

Referring now in more detail to the drawings, FIG. 1 illustrates a container generally designated as 10 which includes a bottom section 12 and a hinged top section 14. The bottom section 12 includes a bottom 15, a front dispensing face 16, end walls 18 and 20, and a back wall 22 which are all made integral with one another. The top section 14 includes a front face 24, end tabs 26 and 28 and a top wall 30. A cutting edge 32 is carried along a lower edge of the front dispensing face 16. A roll 34 of plastic film wrap material W is carried within the bottom section 12 of the container.

Figure 2:
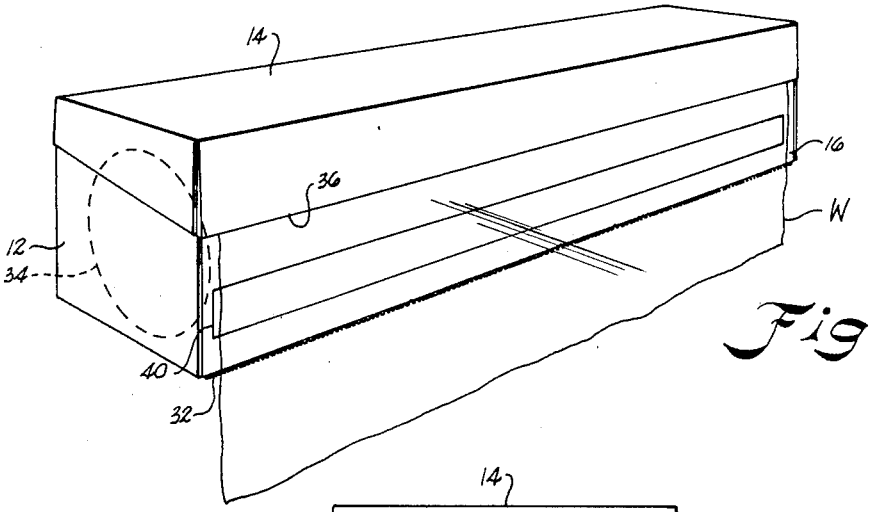
FIG. 2 is a perspective view illustrating a plastic film wrap box constructed according to the present invention with the plastic film wrap being dispensed therefrom.
Figure 3:
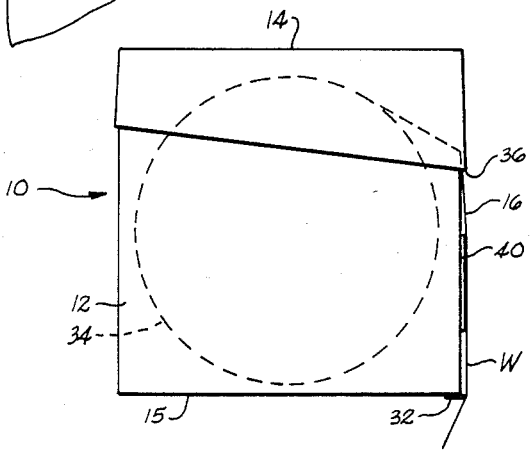
FIG. 3 is an end view illustrating the plastic film wrap box constructed according to the present invention.

In use, the top section 14 is closed, as can best be seen in FIG. 2, and the plastic film wrap material W is dispensed from a dispensing opening 36 which is defined between the front face 16 and the lower edge 24*a* of the front face of the top section.

In accordance with the present invention, adherence means is provided between the dispensing opening 36 and the cutting edge 32 for adhering the plastic film wrap material W to the front face 16 of the dispensing container as the film wrap material is torn across the cutting edge 32 for dispensing. This facilitates cutting and leaves the film wrap material W in position to be readily grasped by the user when the next sheet of film wrap material is desired to be dispensed. The adherence means may be a strip 40 of any suitable material to which the plastic film wrap will adhere. As illustrated, the adherence means includes a strip 40 of polymeric or plastic material which will attract and adhere the plastic film wrap material W. The strip 40 projects outward from and extends substantially the length ofthe front face 24 of the container 10. One suitable material is polyethylene which has been found to be highly effective for attracting plastic film wrap material sold under the trademark HANDI-WRAP II. The polyethylene film is approximately 0.5 mil in thickness and is attached to the box by any suitable means of adhesive on the reverse side of the polyethylene strip. A particular polyethylene material is that sold under the name Saranex 23TX of 2 mil thickness manufactured by Dow Chemical Co. A suitable adhesive is a urethane adhesive manufactured by the Dow-Corning Co. In the preferred form, the adherence means 40 is a continuous elongated strip which extends generally across the entire front facing of the bottom section 12. Other suitable material is glass or other silica compositions.

Thus it can be seen that a highly advantageous container for dispensing clinging type plastic film wrap material is illustrated in which the free edge of the material is always left adhered to the face of the dispensing container to be readily grasped for dispensing a next piece of film wrap material. The problems of finding the free end and of removing the free end from the roll of film wrap material to which it is often found clinging are thus avoided by the present invention. The film wrap adheres to strip 40 so that additional material is not withdrawn from the roll as the material is torn across the cutting edge.

Figure 4:
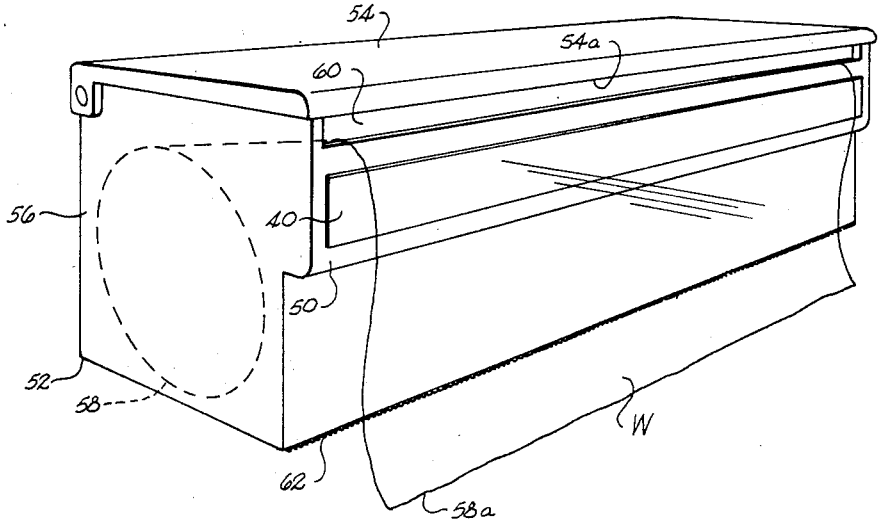
FIG. 4 is a perspective view illustrating another embodiment of the plastic film wrap box constructed according to the present invention.
Figure 5:
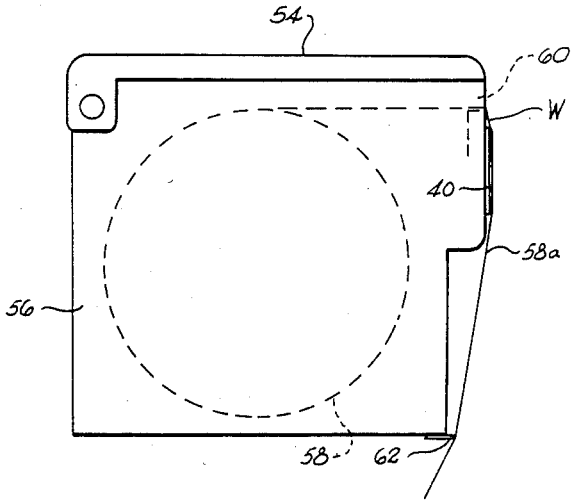
FIG. 5 is an end view of the box of FIG. 4.

In FIGS. 4 and 5, the adherence strip means 40 is illustrated as being attached to an outwardly projecting front face 50 of a plastic decorative type dispensing container 52. A hinged top section 54 is carried on a bottom section 56 of the container 52. A roll 58 of plastic film wrap material is carried within the box and a free end 58*a* of the film wrap material W is adhered to the strip 40 having been previously severed by a cutting edge 62. A dispensing opening 60 formed at an edge 54*a* of the top section and the front face 50 of the container provides an opening through which the film wrap W may be dispensed. By carrying the adherence means 40 on the protruding face 50, the plastic film wrap material W is made to adhere tightly to the strip 40 as it is pulled across the cutting edge 62.

It can be seen that the free edge 58*a* of the plastic film wrap material W is left in a fixed position to be readily grasped for dispensing a next piece of film wrap material W. In this case, a free edge will be left below the projecting face which can be readily grasped.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

What is claimed is:

1. A container device for dispensing plastic film wrap material of the clinging type which comprises a bottom section for receiving a roll of the plastic film wrap material, said bottom section including a bottom, spaced end walls extending up from said bottom, and a front dispensing face integral with said end walls and said bottom, a top section hinged to said bottom section for covering said bottom section; an elongated dispensing opening formed across said dispensing face through which said plastic film wrap material is dispensed; a cutting strip carried adjacent a lower portion of said front face for severing said plastic film wrap material when torn across said cutting strip for separating and dispensing individual sheets of said plastic film wrap material from said roll; and an elongated adherence strip including a strip of adherence material carried across substantially the length of said dispensing face between said dispensing opening and said cutting strip to which said plastic film wrap material adheres when said plastic film wrap material is torn across said cutting strip; said strip of adherence material adhering a free edge of said plastic film wrap material which has been cut to the front face of said container; and and said front face including a forward projecting face which carries said elongated adherence strip, said projecting face projecting outwards beyond a portion of said front face on which said cutting edge is carried whereby a portion of said plastic film wrap material is drawn positively across said elongated adherence strip while being torn across said cutting edge facilitating cutting, and said free edge of said plastic film wrap material which has been left after said portion of plastic film wrap material has been torn off of said roll being readily available in a dispensing position for repeated grasping and dispensing of said film wrap material as said plastic film wrap material is adhered to said projecting front face of said container.

2. The device of claim 1 wherein said strip of adherence material is polyethylene.

3. The device of claim 1 wherein said strip of adherence material is glass.

* * * * *